US007798626B2

(12) United States Patent
Jones et al.

(10) Patent No.: US 7,798,626 B2
(45) Date of Patent: Sep. 21, 2010

(54) SYSTEM FOR LOADING AND FEEDING SOLID INK STICKS TO AN INK MELTER IN A PHASE CHANGE INK PRINTER

(75) Inventors: Brent R. Jones, Sherwood, OR (US); Brian Walter Aznoe, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 876 days.

(21) Appl. No.: 11/712,105

(22) Filed: Feb. 28, 2007

(65) Prior Publication Data

US 2008/0204532 A1 Aug. 28, 2008

(51) Int. Cl.
*B41J 2/175* (2006.01)

(52) U.S. Cl. ..... 347/88

(58) Field of Classification Search ..... 347/85, 347/88, 99

See application file for complete search history.

(56) References Cited

U.S. PATENT DOCUMENTS

| | | | |
|---|---|---|---|
| 5,223,860 | A | 6/1993 | Loofbourow et al. |
| 5,442,387 | A | 8/1995 | Loofbourow et al. |
| 5,510,821 | A | 4/1996 | Jones et al. |
| 5,734,402 | A | 3/1998 | Rousseau et al. |
| 5,861,903 | A | 1/1999 | Crawford et al. |
| 5,975,690 | A | 11/1999 | Grellmann et al. |
| 6,056,394 | A | 5/2000 | Rousseau et al. |
| 6,530,655 | B2 | 3/2003 | Jones et al. |
| 6,543,867 | B1 | 4/2003 | Jones |
| 6,572,225 | B1 | 6/2003 | Jones |
| 6,679,591 | B2 | 1/2004 | Jones |
| 6,705,710 | B2 | 3/2004 | Jones et al. |
| 6,709,094 | B2 | 3/2004 | Jones |
| 6,719,413 | B2 | 4/2004 | Jones |
| 6,719,419 | B2 | 4/2004 | Jones et al. |
| 6,722,764 | B2 | 4/2004 | Jones et al. |

(Continued)

FOREIGN PATENT DOCUMENTS

| | | | |
|---|---|---|---|
| EP | 1359020 | A1 | 11/2003 |

(Continued)

OTHER PUBLICATIONS

EP Search Report, European Patent Office, Mar. 25, 2009.

(Continued)

*Primary Examiner*—An H Do
(74) *Attorney, Agent, or Firm*—Maginot, Moore & Beck LLP

(57) ABSTRACT

A solid ink delivery system for a phase change ink image generator includes a solid ink stick loader and a solid ink stick feeder that cooperate to provide solid ink sticks to an ink melter. The solid ink delivery system includes a solid ink stick loader having a moving support that transports a solid ink stick from a loading area and a solid ink stick feeder having a moving gripper for engaging a solid ink stick received from the solid ink stick moving support. The moving gripper remains in engagement with the solid ink stick as the ink stick is delivered to an ink melter and converted to liquid ink. The loader and gripper members of the delivery system interact with ink sticks that are configured with drive engagement structures at opposed sides of the ink stick.

18 Claims, 6 Drawing Sheets

U.S. PATENT DOCUMENTS

| | | | | |
|---|---|---|---|---|
| 6,739,713 | B2 | 5/2004 | Jones et al. | |
| 6,755,517 | B2 | 6/2004 | Jones et al. | |
| 6,761,443 | B2 | 7/2004 | Jones | |
| 6,761,444 | B2 | 7/2004 | Jones et al. | |
| 6,840,612 | B2 | 1/2005 | Jones et al. | |
| 6,840,613 | B2 | 1/2005 | Jones | |
| 6,893,121 | B2 | 5/2005 | Jones | |
| 6,966,644 | B2 | 11/2005 | Jones et al. | |
| 6,986,570 | B2 | 1/2006 | Jones et al. | |
| 7,066,589 | B2 | 6/2006 | Jones et al. | |
| 7,104,635 | B2 | 9/2006 | Jones | |
| 7,108,363 | B2 | 9/2006 | Jones et al. | |
| 7,207,668 | B2 * | 4/2007 | Jones et al. | 347/88 |
| 2003/0202064 | A1 | 10/2003 | Jones et al. | |
| 2003/0202067 | A1 | 10/2003 | Jones et al. | |
| 2003/0202074 | A1 | 10/2003 | Jones | |

FOREIGN PATENT DOCUMENTS

| | | | |
|---|---|---|---|
| EP | 1731311 | A2 | 12/2006 |

OTHER PUBLICATIONS

Non-Final Office Action for U.S. Appl. No. 11/605,015, mailed Sep. 16, 2009, United States Patent and Trademark Office (10 pages).
Amendment in Response to Non-Final Office Action for U.S. Appl. No. 11/605,015, submitted Dec. 16, 2009 (13 pages).
Non-Final Office Action for U.S. Appl. No. 11/605,100, mailed Jun. 10, 2009, United States Patent and Trademark Office (13 pages).
Amendment in Response to Non-Final Office Action for U.S. Appl. No. 11/605,100, submitted Sep. 10, 2009 (12 pages).
Final Office Action for U.S. Appl. No. 11/605,100, mailed Dec. 18, 2009, United States Patent and Trademark Office (8 pages).
Amendment accompanying a Request for Continued Examination for U.S. Appl. No. 11/605,100, submitted Mar. 11, 2010 (8 pages).
Non-Final Office Action for U.S. Appl. No. 11/644,615, mailed Jun. 18, 2009, United States Patent and Trademark Office (10 pages).
Amendment in Response to Non-Final Office Action for U.S. Appl. No. 11/644,615, submitted Sep. 18, 2009 (11 pages).
Final Office Action for U.S. Appl. No. 11/644,615, mailed Dec. 11, 2009, United States Patent and Trademark Office ( pages).
Amendment accompanying a Request for Continued Examination for U.S. Appl. No. 11/644,615, submitted Mar. 11, 2010 (11 pages).

* cited by examiner

SYSTEM FOR LOADING AND FEEDING SOLID INK STICKS TO AN INK MELTER IN A PHASE CHANGE INK PRINTER

CROSS-REFERENCE TO RELATED APPLICATIONS

Reference is made to commonly-assigned co-pending U.S. patent application Ser. No. 11/605,015, which was filed on Nov. 28, 2006, and which was entitled "INTERMEDIATE SIDE SLOT VERTICAL INK CONSTRAINT WITH OFF-SET SUPPORT," by Brent R. Jones et al., and to commonly-assigned co-pending U.S. patent application Ser. No. 11/605,100, which was also filed on Nov. 28, 2006, and which is entitled "LATERAL ANTI-SKEWING SOLUTION FOR SOLID INK", by Brent R. Jones et al., the disclosure of both applications are hereby expressly incorporated herein by reference in their entireties.

TECHNICAL FIELD

This disclosure relates generally to phase change ink printers, the ink sticks used in such ink printers, and the devices and methods used to provide ink to such printers.

BACKGROUND

Solid ink or phase change ink printers conventionally receive ink in a solid form, either as pellets or as ink sticks. The solid ink pellets or ink sticks are typically placed in an "ink loader" that is adjacent to a feed chute or channel. A feed mechanism moves the solid ink sticks from the ink loader into the feed chute and channel and then urges the ink sticks through the feed channel to a heater assembly where the ink is melted. In some solid ink printers, gravity pulls solid ink sticks through the feed channel to the heater assembly. Typically, a heater plate ("melt plate") in the heater assembly melts the solid ink impinging on it into a liquid that is delivered to a print head for jetting onto a recording medium. U.S. Pat. No. 5,734,402 for a Solid Ink Feed System, issued Mar. 31, 1998 to Rousseau et al.; and U.S. Pat. No. 5,861,903 for an Ink Feed System, issued Jan. 19, 1999 to Crawford et al., the disclosures of which are incorporated herein by reference, describe exemplary systems for using solid ink sticks ("phase change ink sticks") in a phase change ink printer.

FIG. 1 is a perspective view of a prior art phase change ink printer 110 having a solid ink feed system as described in the Crawford patent noted above. Printer 110 includes an outer housing having a top surface 112 and side surfaces 114. A user interface display, such as a front panel display screen 116, displays information concerning the status of the printer, and user instructions. Buttons 118 or other control actuators for controlling operation of the printer are adjacent the user interface window, or may be at other locations on the printer. An ink jet printing mechanism (not shown) is contained inside the housing. Such a printing mechanism is described in U.S. Pat. No. 5,805,191, entitled Surface Application System, to Jones et al, and U.S. Pat. No. 5,455,604, entitled Ink Jet Printer Architecture and Method, to Adams et al, the disclosures of which are incorporated herein by reference. The top surface of the housing includes a hinged ink access cover 120 that opens (see FIG. 2) to provide the user access to an ink feed system contained under the top surface of the printer housing that delivers ink to the printing mechanism.

FIG. 2 is a partial top perspective view of the prior art phase change ink printer 110 with its ink access cover 120 open. As at least partially discernable in FIG. 2, the ink access cover 120 is attached to an ink load link 122 so that when the ink access cover 120 is raised, the ink load link 122 slides and pivots to an ink load position. The interaction of the ink access cover 120 and the ink load link 122 is described in U.S. Pat. No. 5,861,903 for an Ink Feed System, which was noted above. Opening the ink access cover 120 reveals an insertion key plate 126 having keyed openings 124A-D. Each keyed opening 124A, 124B, 124C, 124D provides access to a feed key plate having respective keyed openings positioned at the insertion end(s) of respective individual feed channels 129A, 129B, 129C, 129D of the solid ink feed system. The prior art phase change ink printer 110 is configured to receive ink sticks inserted through the respective keyed openings 124A, 124B, 124C, 124D (as indicated generally by respective insertion direction arrows 131A, 131B, 131C, and 131D). A push block is coupled to the ink load link and is spring-biased to advance or feed the ink sticks through the respective feed channels 129A, 129B, 129C, 129D.

Ink loaders typically hold many ink sticks at once and each individual ink stick typically must travel several times its length to reach the melt plate. The wax-like components from which phase change ink sticks are typically made are typically designed to bond to media of many different types, and, accordingly, they may become slightly sticky in some environmental conditions. Consequently, some phase change ink printers occasionally encounter intermittent sticking and slipping of ink sticks in the ink loaders as the ink sticks are pushed through the ink loaders. Feed channel length and complexity of the feed path may also contribute to the intermittent sticking of ink sticks in the feed channel.

The cover and ink loader link configuration of the prior art printer requires the printer to have a rear loader for solid ink sticks and an ink melter at the front end of the printer. This configuration is compatible with print heads that are located below the front of the drip ink loaders. Open reservoirs into which melted ink drips are not necessary in systems that deliver melted ink from an ink melter to a print head through a conduit, such as the melting chambers shown in commonly assigned, co-pending U.S. patent application bearing Ser. No. 11/411,678, which is entitled "System And Method For Melting Solid Ink Sticks In A Phase Change Ink Printer" and which was filed on Apr. 26, 2006. These types of melting chambers enable the ink loader to be positioned in other locations to optimize the printer architecture. This flexibility would also enable a phase change ink printer to incorporate a scanner more easily so it could operate as a multi-function printer.

As emerging technologies reduce the time for generating solid ink images, faster solid ink delivery systems need to be developed. Increased feed speed, however, may increase the risk of intermittent sticking. Solid ink delivery systems that reduce the risk of intermittent sticking while enabling reduced liquid ink production times are desirable.

SUMMARY

A solid ink delivery system for a phase change ink image generator includes a solid ink stick loader and a solid ink stick feeder that cooperate to provide solid ink sticks to an ink melter. The solid ink delivery system includes a solid ink stick loader having a moving support that transports a solid ink stick from a loading area and a solid ink stick feeder having a moving gripper for engaging a solid ink stick received from the solid ink stick moving support. The moving gripper remains in engagement with the solid ink stick as the ink stick is delivered to an ink melter and converted to liquid ink.

The loader and gripper members of the delivery system interact with ink sticks that are configured with drive engagement structures at opposed sides of the ink stick. A solid ink stick so configured includes a solid ink stick body having a longitudinal length extending in a longitudinal direction, at least one key on at least one side of the solid ink stick body that extends parallel to the longitudinal direction of the ink stick body, a first drive engagement structure positioned proximate a first corner on a first side of the ink stick body, and a second drive engagement structure positioned proximate a second corner on a second side of the ink stick body that is opposed to the first side, the first and the second drive engagement structures being parallel to one another and extending substantially the longitudinal length of the ink stick body and the first and the second drive engagement structures being independent of the key.

The ink delivery system may be incorporated within a phase change ink printer to load and feed solid ink sticks to an ink melter in the phase change printer. The phase change ink printer includes a melt plate being operable to change a phase of a solid ink stick coming into contact with the melt plate, and an ink delivery system comprising a solid ink stick loader mechanism having a moving support that transports a solid ink stick from a loading area and a solid ink stick feeder mechanism having a moving gripper for engaging a solid ink stick received from the solid ink stick moving support.

DETAILED DESCRIPTION

Figure 1:
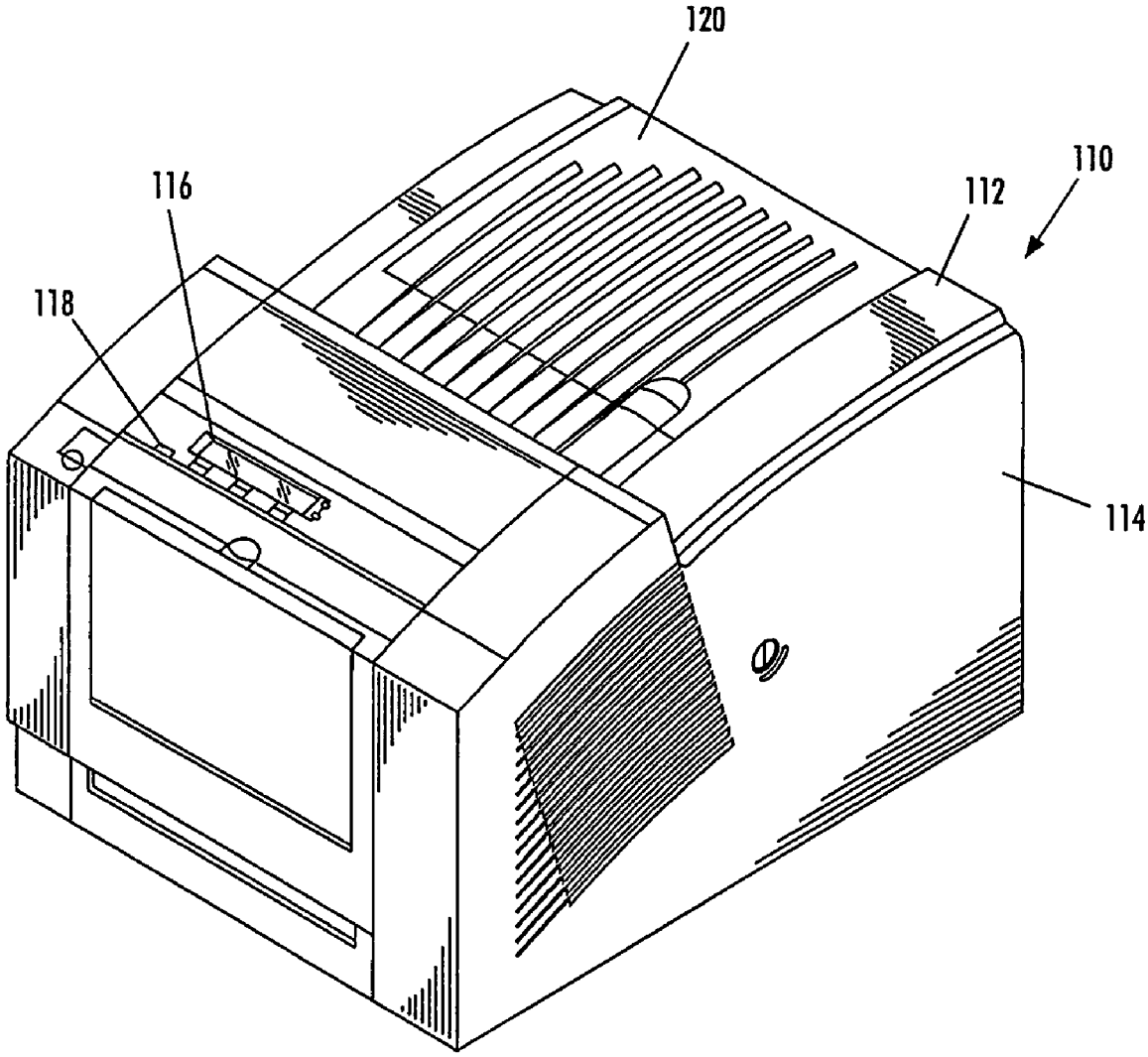
FIG. 1 is a perspective view of a prior art phase change ink printer.
Figure 2:
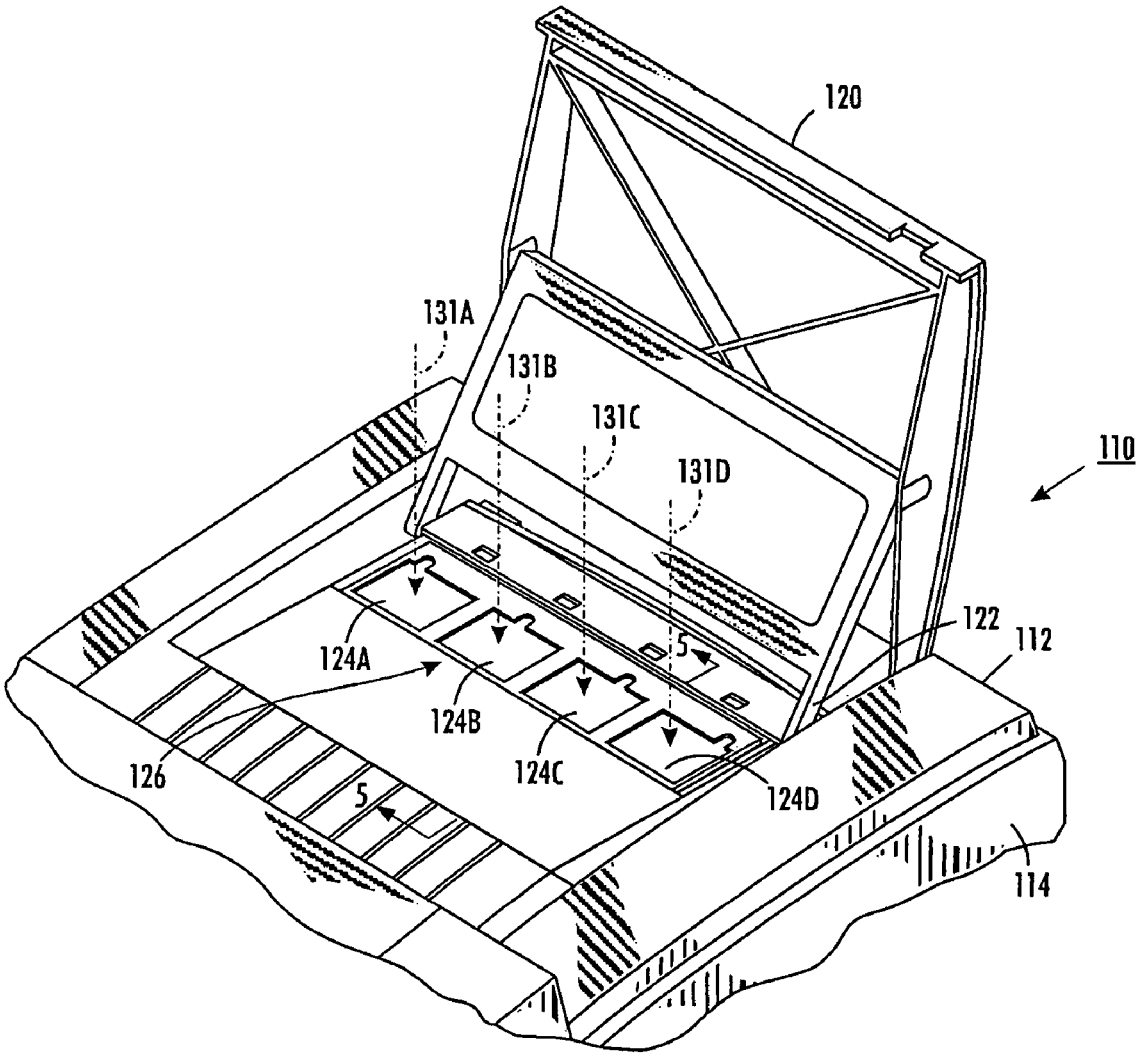
FIG. 2 is a partial top perspective view of the phase change ink printer of FIG. 1 with its ink access cover open.

Like reference numerals refer to like parts throughout the following description and the accompanying drawings.

Figure 3:
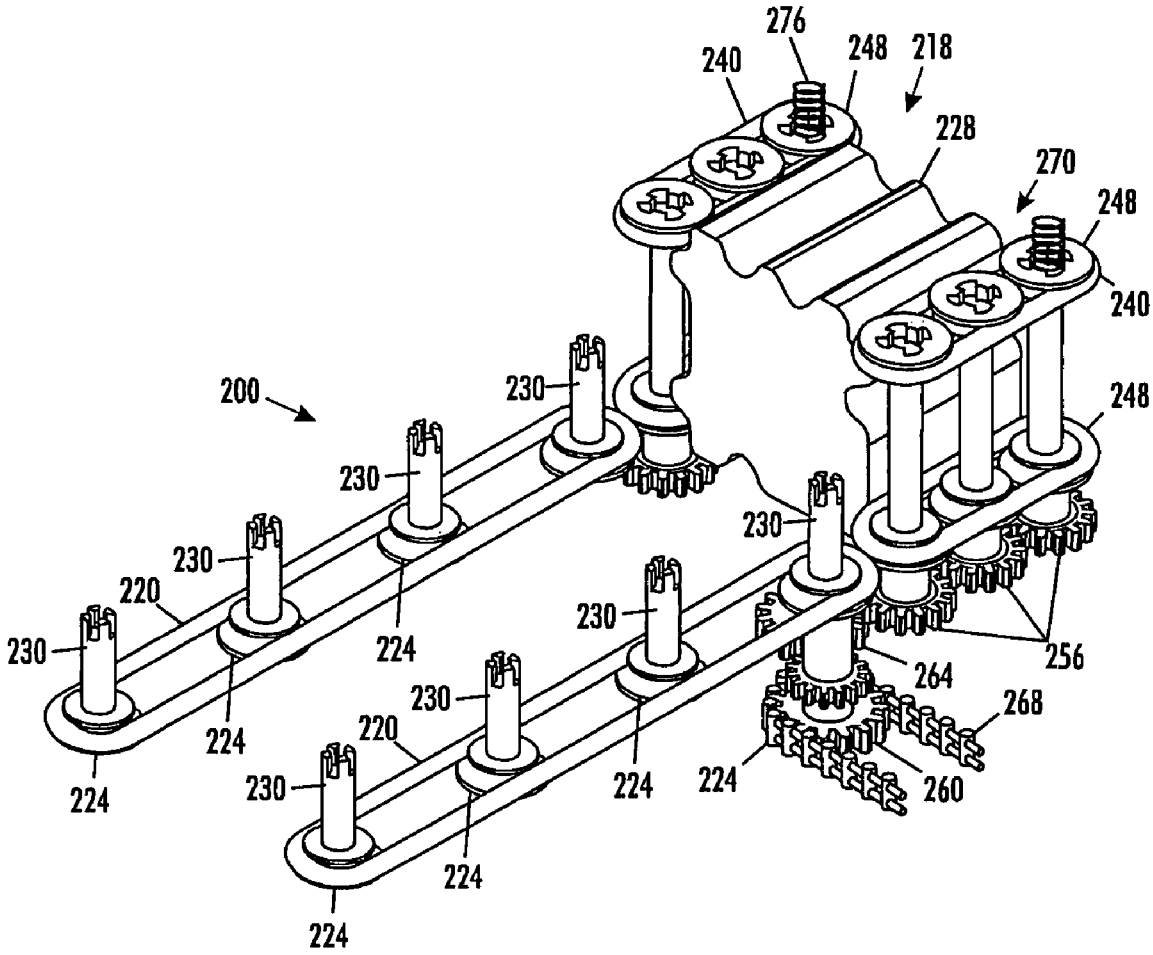
FIG. 3 is a perspective view of an exemplary ink delivery system having a solid ink stick loader mechanism and a solid ink stick feed mechanism.

FIG. 3 is a prospective view of a solid ink stick delivery system 200. The system 200 includes solid ink stick loader mechanism 214 and a solid ink stick feeder mechanism 218 and a solid ink stick 228. The solid ink stick loader mechanism 214 includes a plurality of pulleys 224 that are driven to rotate a moving belt 220. In the embodiment shown in FIG. 3, the solid ink stick loader mechanism 214 includes two pluralities of pulleys 224 and a pair of round moving belts 220. Each set of pulleys and a moving belt are separated by a distance that corresponds to the width between drive engagement structures of an ink stick, such as solid ink stick 228, shown in the figure. The pulleys 224, as shown in the figure, include posts 230 that extend vertically upward from the pulleys 228. In one embodiment, ethylene-propylene was used for round belt material, but other materials, such as polyurethane, may be used.

In another embodiment, the solid ink stick loader mechanism may be a relatively flat belt that is located proximate the drive engagement structures of a solid ink stick, such as solid ink stick 228, shown in the figure. The pulleys that drive such a belt may be vertically oriented, rather than horizontally oriented, as shown in the figure. This belt/pulley configuration may be located in the center of the travel path so one or more ink sticks may be supported with a single belt, although a pair of such flat belts may be separated by the width of the ink sticks to provide support. In yet another embodiment, a looped elastomeric tube may be used as a support belt that is located near the center of the ink stick travel path, although channel walls may be required to help maintain proper vertical orientation of the ink sticks in the loader mechanism 214.

The pulleys and moving belts form a simple conveyor that move solid ink sticks from an insertion end 234 to the ink stick feeder mechanism 218. In one embodiment, the pulleys 224 driving the loader belts 220 are driven a faster rate than the belts of the ink stick feeder mechanism, described in more detail below. As a consequence, ink sticks inserted at the insertion end of the ink stick loader mechanism 214 are quickly moved forward until they contact the sticks ahead. When another ink stick is encountered in the ink stick loader or feeder mechanisms, the moving belts 220 continue to move as they slip along with stationary or slow moving sticks on top of them. This forward motion with ink stick slip enables ink sticks to be loaded into the loader mechanism regardless of the number of sticks that are already present in the loader and feeder mechanism. Each stick is moved forward so that it contacts the stick ahead of it. The load and feed sections of the ink loader assembly described herein can be essentially separate devices or they may be integrated together into a single unit having a separate or common drive.

The insertion end of the loader mechanism may be covered with an access cover. When the access cover is lifted to insert more sticks, a switch state may change and generate a drive signal. The drive signal may be used to activate the motor driving the moving belts in the loader mechanism. Alternatively, the loader may be actuated by inserting a stick into the loader opening where the stick actuates a switch or causes a sensor to generate a drive actuation signal. The loader opening is optimally an insertion opening or key plate having keys that help ensure only sticks of a particular configuration are admitted to the loader. Additionally, the motor driving the moving belts may be actuated in response to a signal generated by the image generating device that indicates ink is required for operation of the device.

The ink stick feeder mechanism 218 of FIG. 3 includes an upper moving belt 240 and a lower moving belt 244 that form a gripper for ink sticks. As used herein, gripper refers to structure in the loader/feeder that sufficiently engages an ink stick so it directs the ink stick in a particular direction. The belts that form an ink stick gripper may be separated by a distance that corresponds to the height of an ink stick. The height tolerance between the upper and lower belt may be relatively tight so the belts clamp or grip an ink stick between them. In one embodiment, the drive members or belts are biased towards the ink sticks they direct for the purpose of feeding the sticks into an ink melter. In one embodiment having biased members or belts, the interaction of the belts with pulleys or other supports that guide the belts may be used to urge the belts towards the ink sticks. For example, a gripping or clamping force may be generated in a localized area by compressing a belt at one or more pulleys. This force may be extended to other portions of the belt by the interaction of the belt with a guide or other support in an area between pulleys. The guide or other support may be urged against the belt by a biasing force, such as a spring, to enhance the gripping action of the belt on an ink stick for delivery of the stick to an ink melter. As used herein, an ink melter may be configured as a plate or other suitable shape for melting solid ink sticks.

As shown in FIG. 3, the belts may be driven by a pair or series of pulleys 248. A biaser 276 may be coupled to exert a force on the surface of one or more upper pulleys 248 to enhance the gripping function between the upper and lower belts. As shown in FIG. 3, the biaser is a spring, although other biasing members may be used to urge the upper belt towards the lower belt such that an ink stick between them is "clamped." Biasers mounted against pulleys or belts that are closer to the ink stick loader mechanism may be configured to exert a weaker biasing force than those closer to the melt end 270. This strength differential helps ensure that an ink stick enters the clamping area of the ink stick feeder mechanism. Of course, other gripping structures may be incorporated in the upper and lower belts or their pulleys to help ensure that the ink sticks are secured within the ink stick feeder mechanism for the delivery of solid ink sticks to an ink stick melter. A gripper is structure that is sized to engage one or more surfaces of an ink stick and maintain pressure on the ink stick to drive it towards and into an ink melter with sufficient feed force to ensure that the ink stick continues to feed into the melter as the stick melts. The exemplary gripper shown in FIG. 3 engages the top and the bottom surface of an ink stick, although the belts may be biased inwardly from the left and the right, in another embodiment, to engage two lateral surfaces of an ink stick. Other structure having protuberances, indentations, or tensioned surfaces, such as the biased belts, may be used to grip one or more ink sticks and drive them towards and into an ink stick melter.

In an embodiment in which belts are used as the moving drive, a pulley and/or belt guide generates a corner load on specially configured ink sticks so the feed force is not strictly across the stick in a lateral direction nor is it strictly across the stick in a vertical direction from the top to the bottom of the stick. Instead, the specially configured ink sticks generate a feed force that is a vector between the strictly lateral force and the strictly vertical force. The added advantage of using an ink stick configuration that results in such a vector force is reliable establishment of positive constraint of the ink stick in a specific feed path and the generation of a grip force that positively feeds the ink stick into the ink melter.

The belt drive ink loader ink stick configuration may include one or more keys that run in the longitudinal direction, which is parallel to the insertion and feed directions. The keys help ensure that only ink sticks having the appropriate color or other ink stick attributes are admitted to an ink stick channel. An ink stick having such a configuration may have four sides, such as the more conventional rectilinear shapes, or it may be five, six, or some other number of sides, provided the belt support and gripping structure are incorporated so at least one pair of opposing drive engagement structures are located at corners of the stick.

Figure 5:
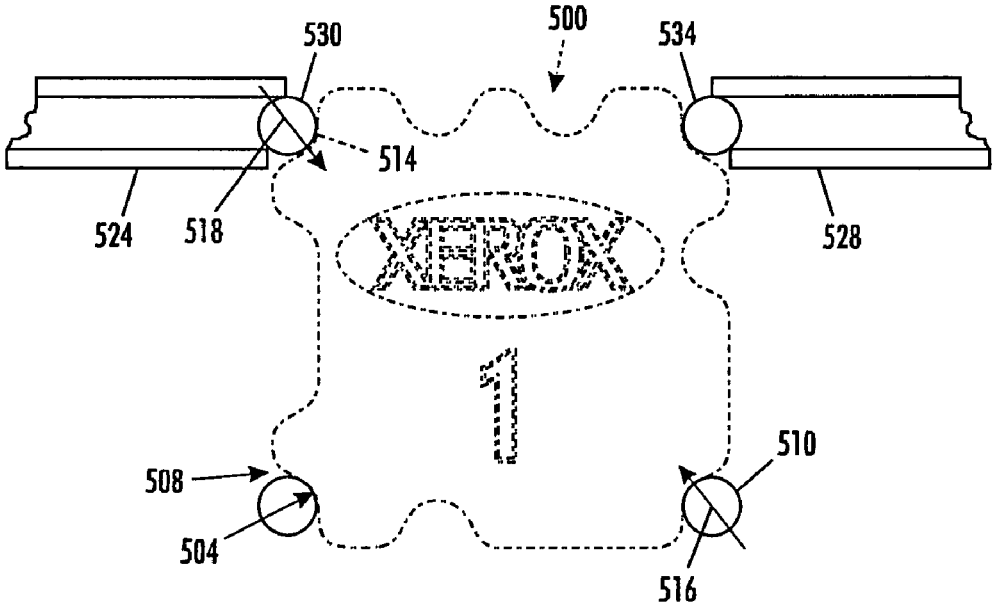
FIG. 5 is a front view of an ink stick configured with drive engagement structures for interaction with the ink delivery system of FIG. 3.
Figure 6:
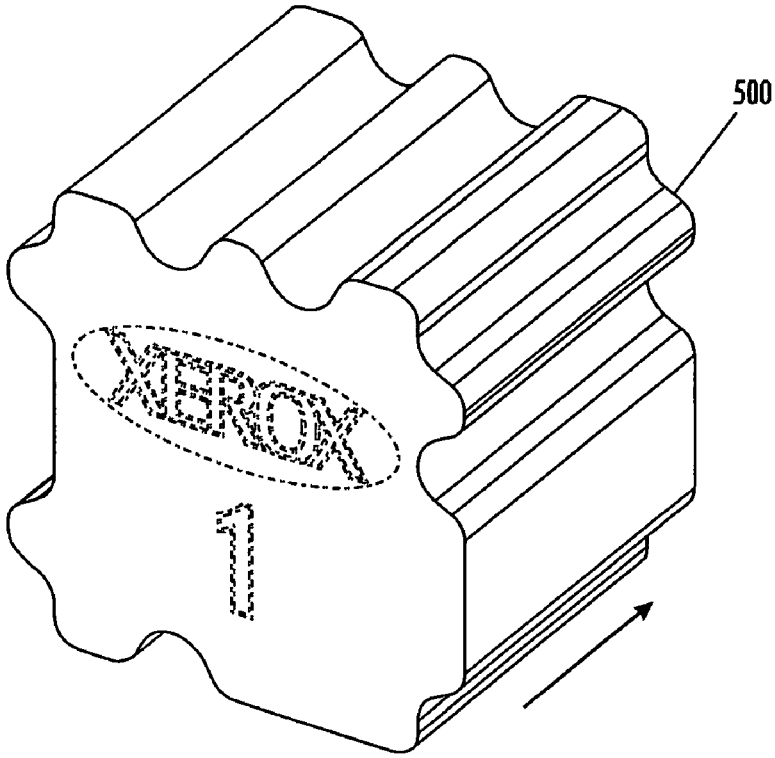
FIG. 6 is a perspective side view of the ink stick shown in FIG. 5.
Figure 7:
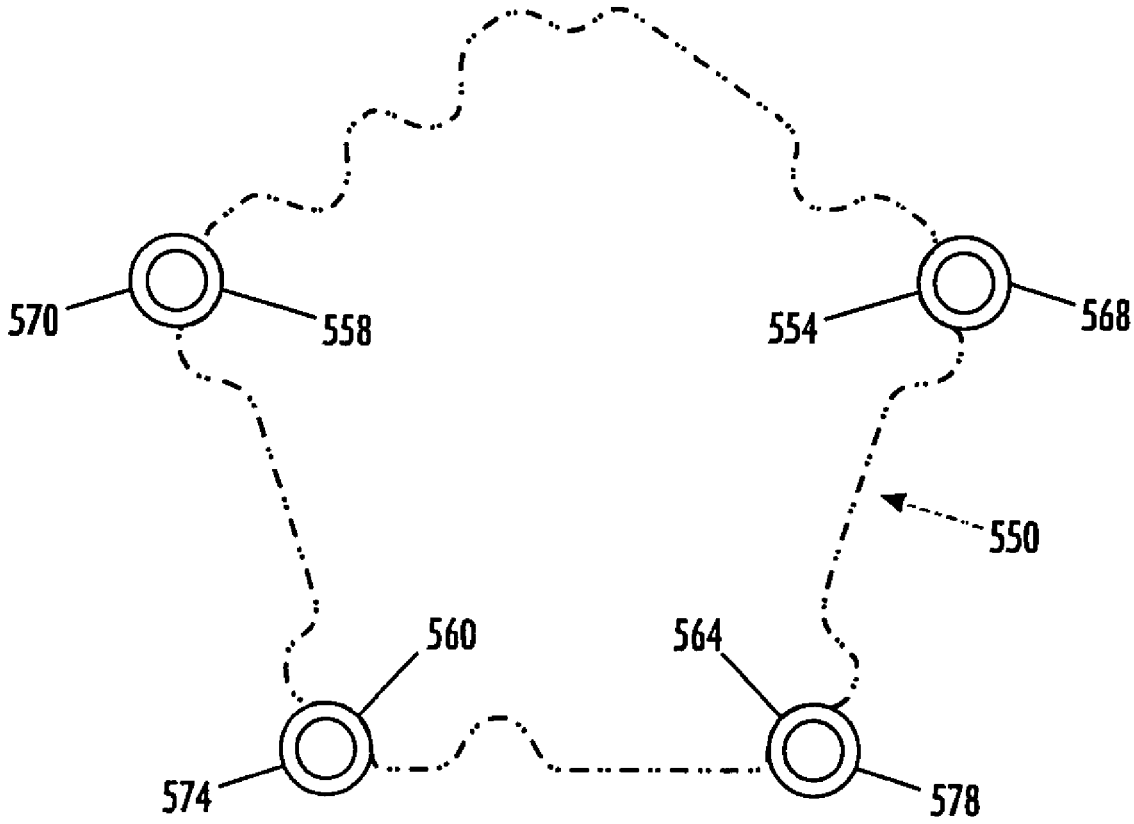
FIG. 7 is a depiction of an alternative embodiment of an ink stick configured with drive engagement structures.

One ink stick configuration is shown in FIG. 5. The ink stick 500 has, for example, an engagement structure 504 that is complementary to, but independent of, an adjacent key 508. The drive engagement structure is independent in the sense that it does not perform or participate in the stick identification function performed by the key. A griping force at engagement structures 510, 514 may be generated in the directions 516, 518, respectively, as shown in the figure. The pulleys 524, 528 that urge the belts 530 and 534, respectively, towards the ink stick 500 may be oriented horizontally, as shown in the figure, vertically, or at some angle between the those two orientations. An exemplary insertion and feed direction for the ink stick 500 is shown in FIG. 6. FIG. 7 depicts a five-sided ink stick configuration 550. The engagement structures 554, 558, 560, and 564 interact with driving belts or members 568, 570, 574, and 578, respectively, to generate gripping forces for transporting the ink stick. As depicted in these figures of a special ink stick body configuration, a solid ink stick body has a longitudinal length extending in a longitudinal direction, which corresponds to the insertion and feed direction of FIG. 6. At least one key is on at least one side of the solid ink stick body that extends parallel to the longitudinal direction of the ink stick body. A first drive engagement structure is positioned proximate a first corner on a first side of the ink stick body, and a second drive engagement structure is positioned proximate a second corner on a second side of the ink stick body that is opposed to the first side. The first and the second drive engagement structures are generally parallel to one another and extend substantially along the longitudinal length of the ink stick body. Additionally, the first and the second drive engagement structures are independent of the key. Also, the front and the back ends of the ink stick body are substantially parallel to one another as well as being substantially perpendicular to the drive engagement structures.

The upper and lower belts 240 and 244 (FIG. 3) are driven by a configuration of pulleys 248 and gears 256 that are coupled to a motor (not shown) by a drive chain 268, a drive sprocket 260, and a controlled slip coupling 260. The upper pulleys 248 and the lower pulleys 248 are coupled to one another by a series of posts 252. An upper pulley, lower pulley, and post may be formed as an integral unit. In another embodiment, an upper pulley and a lower pulley may have a truncated post extending from the pulley. The outboard end of one shaft may be circumferentially reduced to fit within an opening in the truncated shaft of the pulley. A collar on the circumferentially reduced post stops the post from passing into the other post at some predefined distance. This pulley arrangement includes a biaser mounted proximate the pulley having the circumferentially reduced post to resist displacement of the pulley should an ink stick push against the pulley. Continuing with the description of the driver for the feeder mechanism, the lower pulleys 248 are coupled by shafts (not shown) to gears 256. The gears 256 are coupled to a drive sprocket 260 through controlled slip coupling 264. The sprocket 260 is coupled by a drive chain 268 to a motor (not shown). The controlled slip coupling enables the feed belts to be driven a bit faster than the ink stick as it melts. This differential movement helps ensure consistent contact and force of the stick against the melter. As the first stick to contact the melter diminishes in length, the stick(s) following behind the melting stick pushes the diminishing stick completely into the melter. Thus, the drive components may be spaced away from the melter to reduce adverse effects caused by heat in the vicinity of the melter.

In response to actuation of the motor, the drive chain 268 is rotated. The resulting rotation of the drive sprocket 260 is coupled through the slip coupling 264 to the gears 256. Provided the slip coupling passes the rotation through to the gears 256, the lower pulleys 248 rotate and the upper pulleys 248 rotate through the coupling of the upper pulleys to the lower pulleys by the posts 252. The rotation of the pulleys 248 causes the lower belt 244 and the upper belt 240 to rotate. The rotation of the belts 244 and 240 urge an ink stick between the belts to move towards the melting end 270 of the feeder mechanism 218. The gripping action between the belts 240 and 244 helps to hold an ink stick in engagement with an ink melter as the feeder drive urges the ink stick forward.

As shown in FIG. 3, another configuration of an upper belt and a lower belt driven by a plurality of pulleys is located from the first described configuration by a distance that corresponds to the width of the ink stick 228. Thus, the embodiment of the ink stick feeder mechanism 218 shown in FIG. 3 locates two configurations of upper and lower belts for transporting an ink stick to an ink melter near the lateral sides of the ink sticks. Thus, the lower belts of the feeder mechanism shown in the figure are generally aligned with the moving belts 220 of the loader mechanism 214. In another embodiment, however, a centrally located ink stick feeder mechanism may receive ink sticks from an ink stick loader mechanism that has spatially separated moving belts 20, as shown in FIG. 3. Likewise, in another embodiment, an ink stick loader mechanism may use a centrally located belt to delivery ink sticks to an ink stick feeder mechanism having two upper and lower belt configurations that are separated from one another by a distance corresponding to the width of an ink stick. Of course, other configurations and arrangements are possible.

An ink stick delivery system, such as the one shown in FIG. 3, may be provided for each color of ink stick used in a phase change ink printer. A common drive system may be used to drive all of the delivery systems simultaneously, even if only one channel is actually melting and feeding ink to the image generating device. This advantage is obtained through the controlled slip coupling 264.

Figure 4:
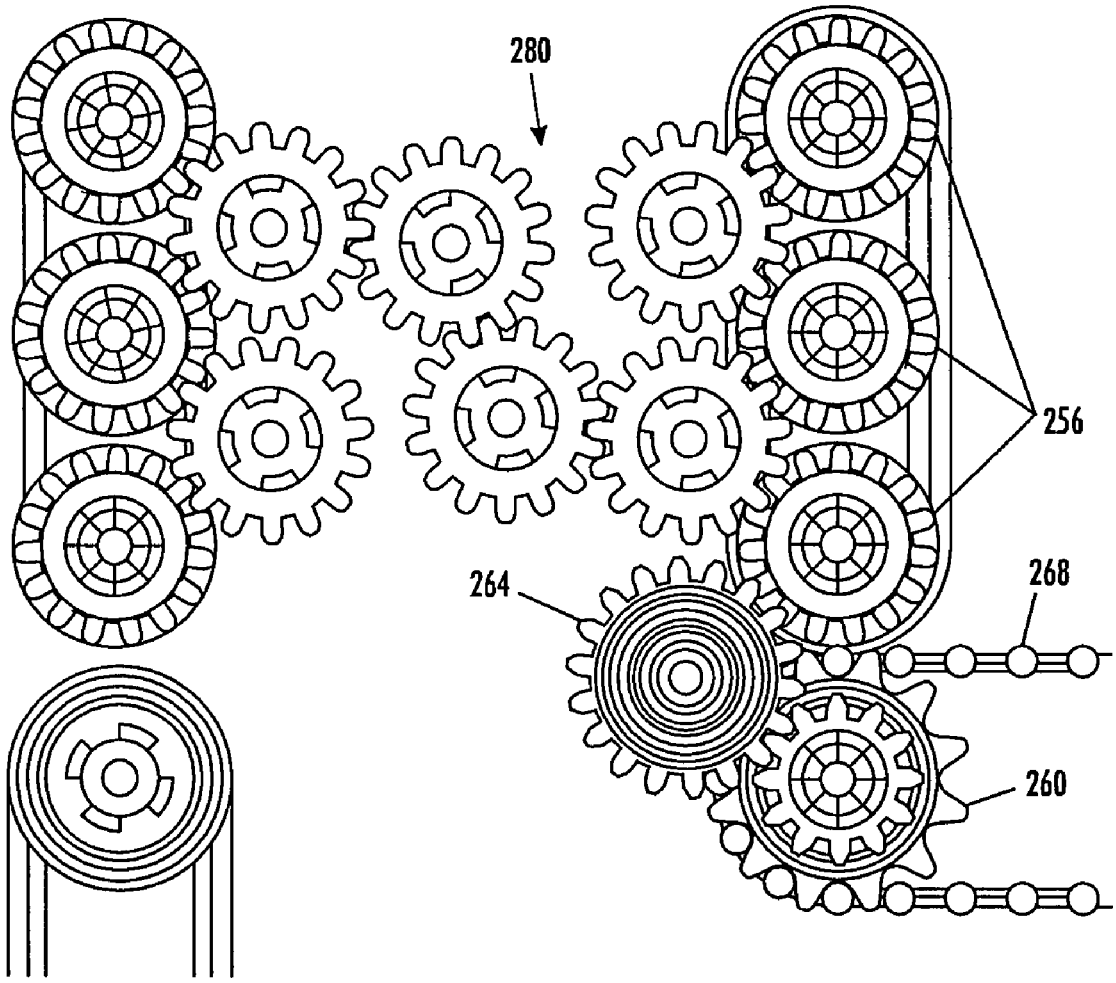
FIG. 4 is a view of an exemplary arrangement of gears that may be used to drive the ink delivery system of FIG. 3.

One configuration of gears, drive chain, and sprocket is depicted in FIG. 4. As already described, actuation of a motor enables the drive chain 268 to rotate the sprocket 260. A shaft 278 extending upwardly from the sprocket also rotates with the sprocket 260. The shaft 278 is coupled to one of the pulleys 224 in the ink stick loader mechanism 214 to drive the moving belt 220. Additionally, the rotation of the sprocket 260 causes the teeth of the sprocket to engage the controlled slip coupling 264. The controlled slip coupling 264 is designed to impart torque transmission to the ink stick feeder mechanism 218 in balance with the amount of force allocated to that function by motor sizing. In one embodiment, the limited slip coupling is implemented with a viscous coupling. The specifics of torque, motor size, belt clamping force, torque transmission through the coupling, belt speed, motor drive gear ratio, and the like are dependent on the geometry of the ink delivery system and the desired capacity of the system. Selection of the appropriate components and operational parameters to implement such a configuration would be within the skill of an ordinary artisan.

Use of a limited slip coupling enables only one drive motor to be used for all of the ink delivery systems. Multiple motors, however, may be used to drive the delivery systems independently, if, for example, bi-directional movement was desired in one ink stick loader mechanism. The motor may be actuated in response to one or more of the ink melters being energized or an insertion area of an ink loader mechanism being accessed. A shaft, chain, series of gears, or other suitable drive components, may be arranged to couple the motor to the pulleys of the ink stick loader mechanisms in the image generating device. These pulleys operate the moving belts of the ink loaders to move ink sticks through the ink loader until they encounter another stick in the loader mechanism or egress the loader and enter the ink feeder mechanism. The ink feeder mechanism clamps the ink sticks and moves them towards the ink melter as a melted layer of ink at the ink stick/melter interface forms and the limited slip coupling urges the gear drive to rotate the pulleys 248 and urge the ink sticks in the ink stick feeder mechanism forward. Thus, the ink feeder mechanism selectively pushes the ink sticks into engagement with the melter.

Loading, supporting, and feeding ink sticks placed on the belt drives of the ink loaders and the ink feeders provides a number of advantages. The contact area between an ink stick and the portion of a belt under an ink stick is small. As the belt material compresses and/or stretches, it changes in width or diameter, and moves slightly, both vertically and laterally, as it carries ink sticks. All of these factors reduce the likelihood that the ink sticks bond to the belt as may occur when ink sticks are pushed over rigid, motionless surfaces. Additionally, open areas underneath the ink sticks enable debris from the sticks to fall out of the travel path of the ink sticks. The ink delivery system described herein may be used to deliver ink sticks to a melting chamber that generates a positive pressure against the molten material ahead of the solidified portion of the ink to force or pump the melted ink to a print head. Because such an ink melter is not required to incorporate a drip reservoir, the arrangement of the ink delivery system components is more flexible. Additionally, a phase change ink printer incorporating an ink delivery system as described herein may be constructed with a front end ink loader rather than the rear loader having a front drip reservoir aligned with the rear loader as previously known.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A solid ink delivery system comprising:

a solid ink stick loader having a moving support that transports a solid ink stick from a loading area; and a solid ink stick feeder having a moving gripper for engaging a solid ink stick received from the solid ink stick moving support and for delivering the solid ink stick to an ink melter, the moving gripper further comprising:

a first moving member configured to move a solid ink stick and apply pressure to a first surface of the solid ink stick; and a second moving member configured to move the solid ink stick and apply pressure to a second surface of the solid ink stick as the solid ink stick is moved by the first member to enable the solid ink stick to be gripped between the first and the second moving members applying pressure to the first and second surfaces of the solid ink stick.

2. The solid ink delivery system of claim 1, the moving support further comprising:

a moving belt that supports a bottom area of the ink stick being transported from the loading area.

3. The solid ink delivery system of claim 1, the moving support further comprising:

a first moving belt; and a second moving belt.

4. The solid ink delivery system of claim 3, the first and the second moving belts being located proximate a bottom area of the ink stick being transported to the ink melter.

5. The solid ink delivery system of claim 1, the moving support of the solid ink stick loader mechanism moving at a different speed than the first and the second moving members of the moving gripper of the solid ink stick feeder mechanism.

6. The solid ink delivery system of claim 5, the moving support moving faster than the first and the second moving members of the moving gripper.

7. The solid ink delivery system of claim 1, on upper wherein the first moving member is a first moving belt positioned to apply pressure to an upper surface of the solid ink stick; and the second moving member is a second moving belt positioned to apply pressure to a lower surface of the solid ink stick to enable the solid ink stick to gripped between the first and the second moving belts.

8. The solid ink delivery system of claim 7, the moving gripper further comprising:

a biaser for biasing one of the first moving belt and the second moving belt towards the other moving belt.

9. A solid ink delivery system comprising:

a solid ink stick loader having a moving support that transports a solid ink stick from a loading area; and a solid ink stick feeder having a first upper belt and a second upper belt; and a first lower belt and a second lower belt, the solid ink stick being gripped between the upper and the lower moving belts.

10. A phase change ink printer comprising:

a melt plate being operable to melt a solid ink stick coming into contact with the melt plate; and a solid ink delivery system comprising:

a solid ink stick loader mechanism having a moving support that transports a solid ink stick from a loading area; and a solid ink stick feeder mechanism having a moving gripper for engaging a solid ink stick received from the solid ink stick moving support and for delivering the solid ink stick to an ink melter, the solid ink feeder mechanism having a first moving belt and a second moving belt, the first moving belt being positioned to apply pressure to a first surface of the solid ink stick and the second moving belt being positioned to apply pressure to a second surface of the solid ink stick.

11. The solid ink delivery system of claim 10, the moving support further comprising:

a third moving belt; and a fourth moving belt.

12. The solid ink delivery of claim 11, the third and the fourth moving belts being located proximate a bottom area of the ink stick being transported to the ink melter.

13. The solid ink delivery system of claim 10, the moving gripper further comprising:

third moving belt positioned to apply pressure to the first surface of the solid ink stick; and fourth moving belt positioned to apply pressure to the second surface of the solid ink stick to enable the solid ink stick to be gripped between at least one of the first and third moving belts and one of the second and fourth moving belts.

14. The solid ink delivery system of claim 10, the moving gripper further comprising:

a biaser configured to bias either the first moving belt or the second moving belt against the solid ink stick.

15. The solid ink delivery system of claim 14, one of the first moving belt and the second moving belt being configured to interact with a drive engagement structure of the ink stick.

16. A solid ink stick comprising:

a solid ink stick body having a longitudinal length extending in a longitudinal direction;

at least one key on at least one side of the solid ink stick body that extends parallel to the longitudinal direction of the ink stick body;

a first drive engagement structure positioned proximate a first corner on a first side of the ink stick body; and a second drive engagement structure positioned proximate a second corner on a second side of the ink stick body that is opposed to the first side, the first and the second drive engagement structures being parallel to one another and extending substantially the longitudinal length of the ink stick body and the first and the second drive engagement structures being independent of the key.

17. The solid ink stick of claim 16, the ink stick comprising:

at least four longitudinal sides;

a first pair of first and second drive engagement structures on opposed sides of the solid ink stick body, the first and the second drive engagement structures being parallel to one another and extending substantially the longitudinal length of the ink stick body and the first and the second drive engagement structures being independent of the key; and a second pair of first and second drive engagement structures on opposed sides of the solid ink stick body, the first and the second drive engagement structures being parallel to one another and extending substantially the longitudinal length of the ink stick body and the first and the second drive engagement structures being independent of the key.

18. The solid ink stick of claim 16 further comprising:

front and back ends of the ink stick body, which are substantially parallel to one another and are substantially perpendicular to the drive engagement structures.

* * * * *